US007857056B2

(12) United States Patent
Kaminsky et al.

(10) Patent No.: US 7,857,056 B2
(45) **Date of Patent: *Dec. 28, 2010**

(54) HYDROCARBON RECOVERY FROM IMPERMEABLE OIL SHALES USING SETS OF FLUID-HEATED FRACTURES

(75) Inventors: Robert D. Kaminsky, Houston, TX (US); William A. Symington, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 100 days.

This patent is subject to a terminal disclaimer.

(21) Appl. No.: 12/252,213

(22) Filed: Oct. 15, 2008

(65) Prior Publication Data

US 2009/0038795 A1 Feb. 12, 2009

Related U.S. Application Data

(63) Continuation of application No. 10/577,332, filed as application No. PCT/US2004/024947 on Jul. 30, 2004, now Pat. No. 7,441,603.

(60) Provisional application No. 60/516,779, filed on Nov. 3, 2003.

(51) Int. Cl.

| | |
|---|---|
| ***E21B 43/267*** | (2006.01) |
| ***E21B 43/17*** | (2006.01) |
| ***E21B 43/24*** | (2006.01) |
| ***E21B 43/40*** | (2006.01) |

(52) U.S. Cl. ..... 166/308.1; 166/266; 166/267; 166/272.2; 166/303; 166/371

(58) Field of Classification Search ..... None
See application file for complete search history.

(56) References Cited

U.S. PATENT DOCUMENTS 895,612 A 8/1908 Baker (Continued)

FOREIGN PATENT DOCUMENTS

GB 1 463 444 2/1977

(Continued)

OTHER PUBLICATIONS (1981) *Oil Shale Technical Handbook*, P. Nowacki (ed.), Noyes Data Corp.

(Continued)

*Primary Examiner*—Zakiya W. Bates
(74) *Attorney, Agent, or Firm*—ExxonMobil Upstream Research Company- Law Department

(57) ABSTRACT

An economic method for in situ maturing and production of oil shale or other deep-lying, impermeable resources containing immobile hydrocarbons. Vertical fractures are created using horizontal or vertical wells. The same or other wells are used to inject pressurized fluids heated to less than approximately 370° C., and to return the cooled fluid for reheating and recycling. The heat transferred to the oil shale gradually matures the kerogen to oil and gas as the temperature in the shale is brought up, and also promotes permeability within the shale in the form of small fractures sufficient to allow the shale to flow into the well fractures where the product is collected commingled with the heating fluid and separated out before the heating fluid is recycled.

27 Claims, 7 Drawing Sheets

U.S. PATENT DOCUMENTS

| | | | | |
|---|---|---|---|---|
| 1,422,204 | A | 7/1922 | Hoover et al. | |
| 2,813,583 | A | 11/1957 | Marx et al. | |
| 2,952,450 | A | 9/1960 | Purre | |
| 2,974,937 | A | 3/1961 | Kiel | |
| 3,205,942 | A | 9/1965 | Sandberg | |
| 3,241,611 | A | 3/1966 | Dougan | |
| 3,284,281 | A | 11/1966 | Thomas | |
| 3,285,335 | A | 11/1966 | Reistle Jr. | |
| 3,358,756 | A | 12/1967 | Vogel | |
| 3,382,922 | A | 5/1968 | Needham | |
| 3,400,762 | A | 9/1968 | Peacock et al. | |
| 3,468,376 | A | 9/1969 | Slusser et al. | |
| 3,500,913 | A | 3/1970 | Nordgren et al. | |
| 3,513,914 | A | 5/1970 | Vogel | |
| 3,515,213 | A | 6/1970 | Prats | |
| 3,516,495 | A | 6/1970 | Patton | |
| 3,521,709 | A | 7/1970 | Needham | |
| 3,528,501 | A | 9/1970 | Parker | |
| 3,695,354 | A | 10/1972 | Dilgren et al. | |
| 3,730,270 | A | 5/1973 | Allred | |
| 3,759,574 | A | 9/1973 | Beard | |
| 3,779,601 | A | 12/1973 | Beard | |
| 3,880,238 | A | 4/1975 | Tham et al. | |
| 3,882,941 | A | 5/1975 | Pelofsky | |
| 3,888,307 | A | 6/1975 | Closmann | |
| 3,967,853 | A | 7/1976 | Closmann et al. | |
| 4,265,310 | A | 5/1981 | Britton et al. | |
| 4,271,905 | A | 6/1981 | Redford et al. | |
| 4,344,485 | A | 8/1982 | Butler | |
| 4,362,213 | A | 12/1982 | Tabor | |
| 4,384,614 | A | 5/1983 | Justheim | |
| 4,483,398 | A | 11/1984 | Peters et al. | |
| 4,706,751 | A | 11/1987 | Gonduin | |
| 4,737,267 | A | 4/1988 | Pao et al. | |
| 4,828,031 | A | 5/1989 | Davis | |
| 4,886,118 | A | 12/1989 | Van Meurs et al. | |
| 4,929,341 | A | 5/1990 | Thirumalachar et al. | |
| 5,036,918 | A | 8/1991 | Jennings et al. | |
| 5,085,276 | A | 2/1992 | Rivas et al. | |
| 5,305,829 | A | 4/1994 | Kumar | |
| 5,377,756 | A | 1/1995 | Northrop et al. | |
| 5,392,854 | A | 2/1995 | Vinegar et al. | |
| 6,016,867 | A | 1/2000 | Gregoli et al. | |
| 6,158,517 | A | 12/2000 | Hsu | |
| 6,328,104 | B1 | 12/2001 | Graue | |
| 6,581,684 | B2 | 6/2003 | Wellington et al. | |
| 6,591,906 | B2 | 7/2003 | Wellington et al. | |
| 6,742,588 | B2 | 6/2004 | Wellington et al. | |
| 6,782,947 | B2 | 8/2004 | de Rouffignac et al. | |
| 6,880,633 | B2 | 4/2005 | Wellington et al. | |
| 6,932,155 | B2 | 8/2005 | Vinegar et al. | |
| 6,948,562 | B2 | 9/2005 | Wellington et al. | |
| 6,964,300 | B2 | 11/2005 | Vinegar et al. | |
| 6,969,123 | B2 | 11/2005 | Vinegar et al. | |
| 7,011,154 | B2 | 3/2006 | Maher et al. | |
| 7,048,051 | B2 | 3/2006 | McQueen | |
| 7,066,254 | B2 | 6/2006 | Vinegar et al. | |
| 7,073,578 | B2 | 7/2006 | Vinegar et al. | |
| 7,104,319 | B2 | 9/2006 | Vinegar et al. | 166/245 |
| 7,121,342 | B2 | 10/2006 | Vinegar et al. | 166/302 |
| 7,441,603 | B2 * | 10/2008 | Kaminsky et al. | 166/308.1 |
| 2005/0269077 | A1 | 12/2005 | Sadberg | 166/249 |
| 2007/0045265 | A1 | 3/2007 | McKinzie, II | 219/207 |

FOREIGN PATENT DOCUMENTS

| | | |
|---|---|---|
| GB | 1 559 948 | 1/1980 |

OTHER PUBLICATIONS

Barnes, A. L. et al. (1968) "Quarterly of the Colorado School of Mines" *Fifth Symposium on Oil Shale*, v. 63(4), Oct. 1968, pp. 83-108.

Burnham, A. K. and Singleton, M. F. (1983) "High-Pressure Pyrolysis of Green River Oil Shale" in *Geochemistry and Chemistry of Oil Shales: ACS Symposium Series*.

Domine, F. et al. (2002) "Up to What Temperature is Petroleum Stable? New Insights from a 5200 Free Radical Reactions Model", *Organic Chemistry*, 33, pp. 1487-1499.

Hill, G. R. et al. (1967) "Direct Production of a Low Pour Point High Gravity Shale Oil", *I&EC Product Research and Development*, 6(1), Mar. 1967, pp. 52-59.

Johnson, D. J. (1966) *Decomposition Studies of Oil Shale*, University of Utah (Thesis).

Moschovidis, Z. (1989) "Interwell Communication by Concurrent Fracturing—a New Stimulation Technique", *Journ. of Canadian Petro. Tech*. 28(5), pp. 42-48.

Needham, R. B. et al. (1976) "Oil Yield and Quality from Simulated In-Situ Retorting of Green River Oil Shale", *Society of Petroleum Engineers*, SPE 6069, Oct. 3-6, 12 pages.

Sahu, D. et al. (1988) "Effect of Benzene and Thiophene on Rate of Coke Formation During Naphtha Pyrolysis", *Canadian Journ. of Chem. Eng*., 66, Oct. 1988, pp. 808-816.

Tisot, P. R. et al. (1970) "Structural Response of Rich Green River Oil Shales to Heat and Stress and Its Relationship to Induced Permeability", *Journal of Chemical Engineering Data*, v. 15(3), pp. 425-434.

Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.

EP Standard Search Report, dated Mar. 19, 2004, 5 pp.

"Hydraulic Fracturing: Reprint Series No. 28", *Soc. of Petroleum Engineers* (1990).

* cited by examiner

HYDROCARBON RECOVERY FROM IMPERMEABLE OIL SHALES USING SETS OF FLUID-HEATED FRACTURES

This application is a continuation application of U.S. patent application Ser. No. 10/577,332 filed on Apr. 28, 2006 now U.S. Pat. No. 7,441,603 and entitled HYDROCARBON RECOVERY FROM IMPERMEABLE OIL SHALES USING SETS OF FLUID HEATED FRACTURES, which is the National Stage of International Application No. PCT/US2004/024947, filed Jul. 30, 2004, and which claims the benefit of U.S. Provisional Patent Application No. 60/516,779, filed Nov. 3, 2003.

FIELD OF THE INVENTION

This invention relates generally to the in situ generation and recovery of hydrocarbon oil and gas from subsurface immobile sources contained in largely impermeable geological formations such as oil shale. Specifically, the invention is a comprehensive method of economically producing such reserves long considered uneconomic.

BACKGROUND OF THE INVENTION

Oil shale is a low permeability rock that contains organic matter primarily in the form of kerogen, a geologic predecessor to oil and gas. Enormous amounts of oil shale are known to exist throughout the world. Particularly rich and widespread deposits exist in the Colorado area of the United States. A good review of this resource and the attempts to unlock it is given in *Oil Shale Technical Handbook*, P. Nowacki (ed.), Noyes Data Corp. (1981). Attempts to produce oil shale have primarily focused on mining and surface retorting. Mining and surface retorts however require complex facilities and are labor intensive. Moreover, these approaches are burdened with high costs to deal with spent shale in an environmentally acceptable manner. As a result, these methods never proved competitive with open-market oil despite much effort in the 1960's-80's.

To overcome the limitations of mining and surface retort methods, a number of in situ methods have been proposed. These methods involve the injection of heat and/or solvent into a subsurface oil shale, in which permeability has been created if it does not occur naturally in the target zone. Heating methods include hot gas injection (e.g., flue gas, methane—see U.S. Pat. No. 3,241,611 to J. L. Dougan—or superheated steam), electric resistive heating, dielectric heating, or oxidant injection to support in situ combustion (see U.S. Pat. No. 3,400,762 to D. W. Peacock et al. and U.S. Pat. No. 3,468,376 to M. L. Slusser et al.). Permeability generation methods include mining, rubblization, hydraulic fracturing (see U.S. Pat. No. 3,513,914 to J. V. Vogel), explosive fracturing (U.S. Pat. No. 1,422,204 to W. W. Hoover et al.), heat fracturing (U.S. Pat. No. 3,284,281 to R. W. Thomas), steam fracturing (U.S. Pat. No. 2,952,450 to H. Purre), and/or multiple wellbores. These and other previously proposed in situ methods have never proven economic due to insufficient heat input (e.g., hot gas injection), inefficient heat transfer (e.g., radial heat transfer from wellbores), inherently high cost (e.g., electrical methods), and/or poor control over fracture and flow distribution (e.g., explosively formed fracture networks and in situ combustion).

Barnes and Ellington attempt to take a realistic look at the economics of in situ retorting of oil shale in the scenario in which hot gas is injected into constructed vertical fractures. (*Quarterly of the Colorado School of Mines* 63, 83-108 (October, 1968). They believe the limiting factor is heat transfer to the formation, and more specifically the area of the contact surfaces through which the heat is transferred. They conclude that an arrangement of parallel vertical fractures is uneconomic, even though superior to horizontal fractures or radial heating from well bores.

Previously proposed in situ methods have almost exclusively focused on shallow resources, where any constructed fractures will be horizontal because of the small downward pressure exerted by the thin overburden layer. Liquid or dense gas heating mediums are largely ruled out for shallow resources since at reasonably fast pyrolysis temperatures (>~270° C.) the necessary pressures to have a liquid or dense gas are above the fracture pressures. Injection of any vapor which behaves nearly as an ideal gas is a poor heating medium. For an ideal gas, increasing temperature proportionately decreases density so that the total heat per unit volume injected remains essentially unchanged. However, U.S. Pat. No. 3,515,213 to M. Prats, and the Barnes and Ellington paper consider constructing vertical fractures, which implies deep reserves. Neither of these references, however, teaches the desirability of maximizing the volumetric heat capacity of the injected fluid as disclosed in the present invention. Prats teaches that it is preferable to use an oil-soluble fluid that is effective at extracting organic components whereas Barnes and Ellington indicate the desirability of injecting superhot (~2000° F.) gases.

Perhaps closest to the present invention is the Prats patent, which describes in general terms an in situ shale oil maturation method utilizing a dual-completed vertical well to circulate steam, "volatile oil shale hydrocarbons", or predominately aromatic hydrocarbons up to 600° F. (315° C.) through a vertical fracture. Moreover, Prats indicates the desirability that the fluid be "pumpable" at temperatures of 400-600° F. However, he describes neither operational details nor field-wide implementation details, which are key to economic and optimal practice. Indeed, Prats indicates use of such a design is less preferable than one which circulates the fluid through a permeability section of a formation between two wells.

In U.S. Pat. No. 2,813,583 to J. W. Marx et al., a method is described for recovering immobile hydrocarbons via circulating steam through horizontal propped fractures to heat to 400-750° F. The horizontal fractures are formed between two vertical wells. Use of nonaqueous heating is described but temperatures of 800-1000° F. are indicated as necessary and thus steam or hot water is indicated as preferred. No discussion is given to the inorganic scale and formation dissolution issues associated with the use of water, which can be avoided by the use of a hydrocarbon heating fluid as disclosed in the present invention.

In U.S. Pat. No. 3,358,756 to J. V. Vogel, a method similar to Marx's is described for recovering immobile hydrocarbons via hot circulation through horizontal fractures between wells. Vogel recommends using hot benzene injected at ~950° F. and recovered at least ~650° F. Benzene however is a reasonably expensive substance which would probably need to be purchased as opposed to being extracted from the generated hydrocarbons. Thus, even low losses in separating the sales product from the benzene, i.e., low levels of benzene left in the sales product, could be unacceptable. The means for high-quality and cost effective separation of the benzene from the produced fluids is not described.

In U.S. Pat. No. 4,886,118 to Van Meurs et al., a method is described for in situ production of shale oil using wellbore heaters at temperatures >600° C. The patent describes how the heating and formation of oil and gas leads to generation of permeability in the originally impermeable oil shale. Unlike the present invention, wellbore heaters provide heat to only a limited surface (i.e. the surface of the well) and hence very high temperatures and tight well spacings are required to inject sufficient thermal energy into the formation for reasonably rapid maturation. The high local temperatures prevent producing oil from the heating injecting wells and hence separate sets of production-only wells are needed. The concepts of the Van Meurs patent are expanded in U.S. Pat. No. 6,581,684 to S. L. Wellington et al. Neither patent advocates heating via hot fluid circulation through fractures.

Several sources discuss optimizing the in situ retort conditions to obtain oil and gas products with preferred compositions. An early but extensive reference is the Ph.D. Thesis of D. J. Johnson (*Decomposition Studies of Oil Shale*, University of Utah (1966)), a summary of which can be found in the journal article "Direct Production of a Low Pour Point High Gravity Shale Oil", *I&EC Product Research and Development,* 6(1), 52-59 (1967). Among other findings Johnson found that increasing pressure reduces sulfur content of the produced oil. High sulfur is a key debit to the value of oil. Similar results were later described in the literature by A. K. Burnham and M. F. Singleton ("High-Pressure Pyrolysis of Green River Oil Shale" in *Geochemistry and Chemistry of Oil Shales: ACS Symposium Series* (1983)). Most recently, U.S. Pat. No. 6,581,684 to S. L. Wellington et al. gives correlations for oil quality as a function of temperature and pressure. These correlations suggest modest dependence on pressure at low pressures (<~300 psia) but much less dependence at higher pressures. Thus, at the higher pressures preferred for the present invention, pressure control essentially has no impact on sulfur percentage, according to Wellington. Wellington primarily contemplates borehole heating of the shale.

Production of oil and gas from kerogen-containing rocks such as oil shales presents three problems. First, the kerogen must be converted to oil and gas that can flow. Conversion is accomplished by supplying sufficient heat to cause pyrolysis to occur within a reasonable time over a sizeable region. Second, permeability must be created in the kerogen-containing rocks, which may have very low permeability. And third, the spent rock must not pose an undue environmental or economic burden. The present invention provides a method that economically addresses all of these issues.

SUMMARY OF THE INVENTION

In one embodiment, the invention is an in situ method for maturing and producing oil and gas from a deep-lying, impermeable formation containing immobile hydrocarbons such as oil shale, which comprises the steps of (a) fracturing a region of the deep formation, creating a plurality of substantially vertical, parallel, propped fractures, (b) injecting under pressure a heated fluid into one part of each vertical fracture and recovering the injected fluid from a different part of each fracture for reheating and recirculation, (c) recovering, commingled with the injected fluid, oil and gas matured due to the heating of the deposit, the heating also causing increased permeability of the hydrocarbon deposit sufficient to allow the produced oil and gas to flow into the fractures, and (d) separating the oil and gas from the injected fluid. Additionally, many efficiency-enhancing features compatible with the above-described basic process are disclosed.

In one general aspect, an in situ method for maturing and producing oil and gas from a deep-lying, impermeable formation containing immobile hydrocarbons, includes the steps of (a) pressure fracturing a region of the hydrocarbon formation, creating a plurality of substantially vertical, propped fractures; (b) injecting under pressure a heated fluid into a first part of each vertical fracture, and recovering the injected fluid from a second part of each fracture for reheating and recirculation, said pressure being less than the fracture opening pressure, said injected fluid being heated sufficiently that the fluid temperature upon entering each fracture is at least 260° C. but not more than 370° C., and the separation between said first and second parts of each fracture being less than or approximately equal to 200 meters; (c)

recovering, commingled with the injected fluid, oil and gas matured in the region of the hydrocarbon formation due to heating of the region by the injected fluid, the permeability of the formation being increased by such heating thereby allowing flow of the oil and gas into the fractures; and (d) separating the produced oil and gas from the recovered injection fluid.

Implementations of this aspect may include one or more of the following features. For example, the hydrocarbon formation may be oil shale. The fractures may be substantially parallel. At least eight fractures may be created, spaced substantially uniformly at a spacing in the range 10-60 m, the fractures being propped to have permeability of at least 200 Darcy. At least one well may be used to create the fractures and to inject and recover the heated fluid from the fractures. One or more, or all of the wells may be vertical wells or horizontal wells. The wells may be used to create fractures and may also be used for injection and recovery.

The injection and recovery wells may have a plurality of completions in each fracture, at least one completion being used for injection of the heated fluid and at least one completion being used for recovery of the injected fluid. The injection well and the recovery well may have three or more completions in each fracture, and at least one completion of the three or more completions may be used for injection of the heated fluid and at least one completion of the three or more completions may be used for recovery of the injected fluid. The injection and return completions may be periodically reversed to cause a more even temperature profile across the fracture. The wells may lie substantially within the plane of their associated fractures. The planes of the fractures may be substantially parallel and the wells may be horizontal and substantially perpendicular to the planes of the fractures. The injected fluid may be saturated steam and the injection pressure may be in the range 1,200-3,000 psia, but not more than the fracture opening pressure. The depth of the heated region of the formation may be at least 1,000 ft. The heating of the hydrocarbon formation may be continued at least until the temperature distribution across each fracture is substantially constant. The depth of the heated region of the hydrocarbon formation may be below the lowest-lying aquifer and a patchwork of sections of the hydrocarbon formation are left unheated to serve as pillars to prevent subsidence. The fluid pressure maintained in each fracture may be at least 50% of the fracture opening pressure. The fluid pressure maintained in each fracture may be at least 80% of the fracture opening pressure. The non-Darcy flow of the injected fluid may be substantially maintained throughout each fracture to the degree that the velocity squared term in the Ergun equation contributes at least 25% of the pressure drop calculated by such equation.

Wells that intersect fractures may be drilled while the fractures are pressurized above the drilling mud pressure. A degradation or coking inhibitor may be added to the injected fluid. The hydrocarbon region that is fractured may lie about 1,000 feet or more below the earth's surface. The oil shale region to be fractured may lie about 1,000 feet or more below the earth's surface. The fracture may include two or more smaller fractures. A flow path may be created for the injected and recovered fluids by intersecting the fracture with one or more wells substantially perpendicular to the plane of the fractures. The fractures may be substantially perpendicular to the direction of the wells from which they are formed.

BRIEF DESCRIPTION OF THE DRAWINGS

The present invention and its advantages will be better understood by referring to the following detailed description and the attached drawings in which.

Figure 1:
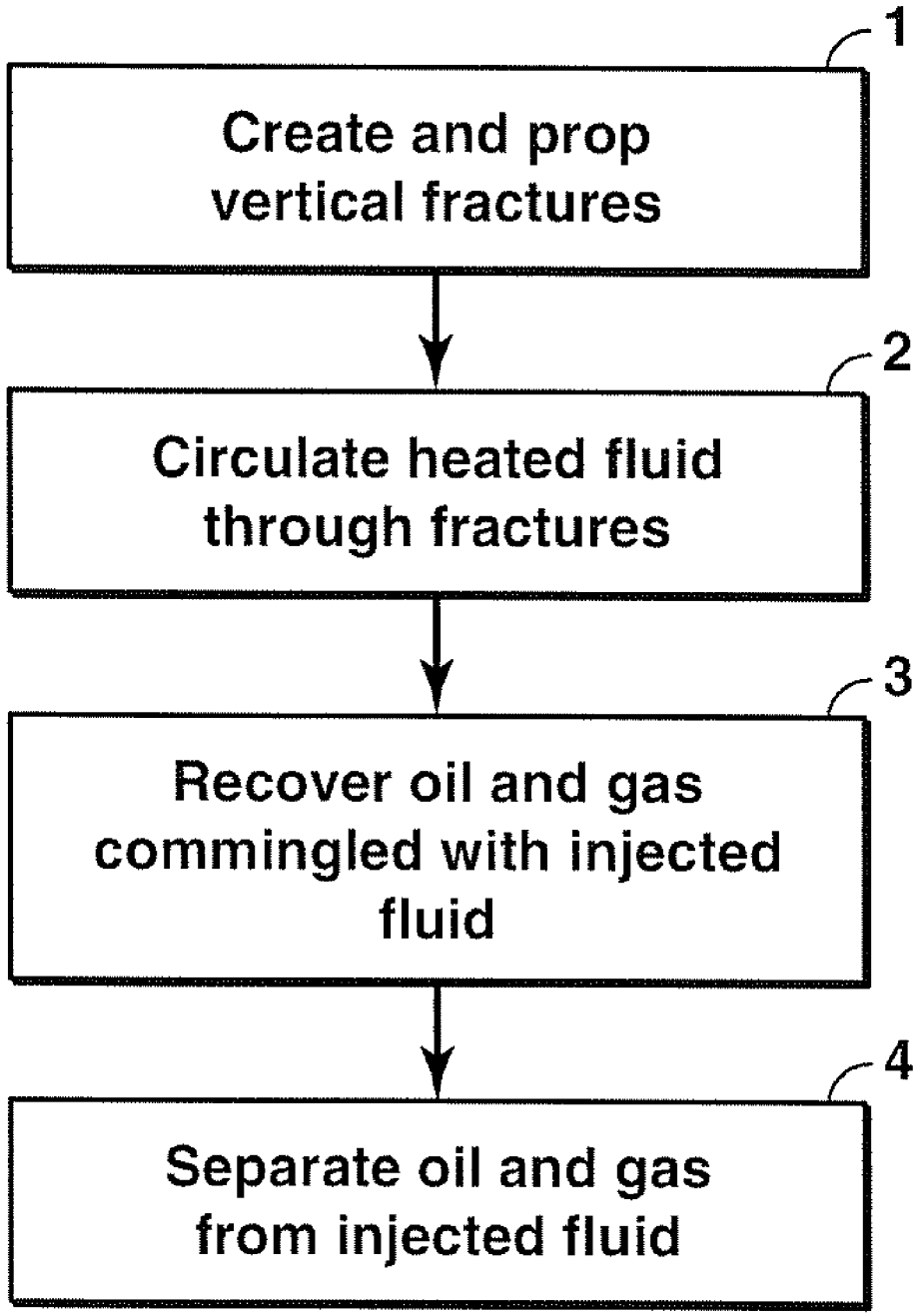
FIG. 1 is a flow chart showing the primary steps of the present inventive method.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications and equivalents that may be included within the spirit and scope of the invention, as defined by the appended claims.

DETAILED DESCRIPTION OF THE PREFERRED EMBODIMENTS

The present invention is an in situ method for generating and recovering oil and gas from a deep-lying, impermeable formation containing immobile hydrocarbons such as, but not limited to, oil shale. The formation is initially evaluated and determined to be essentially impermeable so as to prevent loss of heating fluid to the formation and to protect against possible contamination of neighboring aquifers. The invention involves the in situ maturation of oil shales or other immobile hydrocarbon sources using the injection of hot (approximate temperature range upon entry into the fractures of 260-370° C. in some embodiments of the present invention) liquids or vapors circulated through tightly spaced (10-60 m, more or less) parallel propped vertical fractures. The injected heating fluid in some embodiments of the invention is primarily supercritical "naphtha" obtained as a separator/distillate cut from the production. Typically, this fluid will have an average molecular weight of 70-210 atomic mass units. Alternatively, the heating fluid may be other hydrocarbon fluids, or non-hydrocarbons, such as saturated steam preferably at 1,200 to 3,000 psia. However, steam may be expected to have corrosion and inorganic scaling issues and heavier hydrocarbon fluids tend to be less thermally stable. Furthermore, a fluid such as naphtha is likely to continually cleanse any fouling of the proppant (see below), which in time could lead to reduced permeability. The heat is conductively transferred into the oil shale (using oil shale for illustrative purposes), which is essentially impermeable to flow. The generated oil and gas is co-produced through the heating fractures. The permeability needed to allow product flow into the vertical fractures is created in the rock by the generated oil and gas and by the thermal stresses. Full maturation of a 25 m zone may be expected to occur in ~15 years. The relatively low temperatures of the process limits the generated oil from cracking into gas and limits $CO_2$ production from carbonates in the oil shale. Primary target resources are deep oil shales (>~1000 ft) so to allow pressures necessary for high volumetric heat capacity of the injected heating fluid. Such depths may also prevent groundwater contamination by lying below fresh water aquifers.

Additionally the invention has several important features including:

1) It avoids high temperatures (>~400° C.) which causes $CO_2$ generation via carbonate decomposition and plasticity of the rock leading to constriction of flow paths.
2) Flow and thermal diffusion are optimized via transport largely parallel to the natural bedding planes in oil shales. This is accomplished via the construction of vertical fractures as heating and flow pathways. Thermal diffusivities are up to 30% higher parallel to the bedding planes than across the bedding planes. As such, heat is transferred into the formation from a heated vertical fracture more rapidly than from a horizontal fracture. Moreover, gas generation in heated zones leads to the formation of horizontal fractures which provides permeability pathways. These secondary fractures will provide good flow paths to the primary vertical fractures (via intersections), but would not if the primary fractures were also horizontal.
3) Deep formations (>~1000 ft) are preferred. Depth is required to provide sufficient vertical-horizontal stress difference to allow the construction of closely spaced vertical fractures. Depth also provides sufficient pressure so that the injected heat-carrying fluids are dense at the required temperatures. Furthermore, depth reduces environmental concerns by placing the pyrolysis zone below aquifers.

Figure 2:
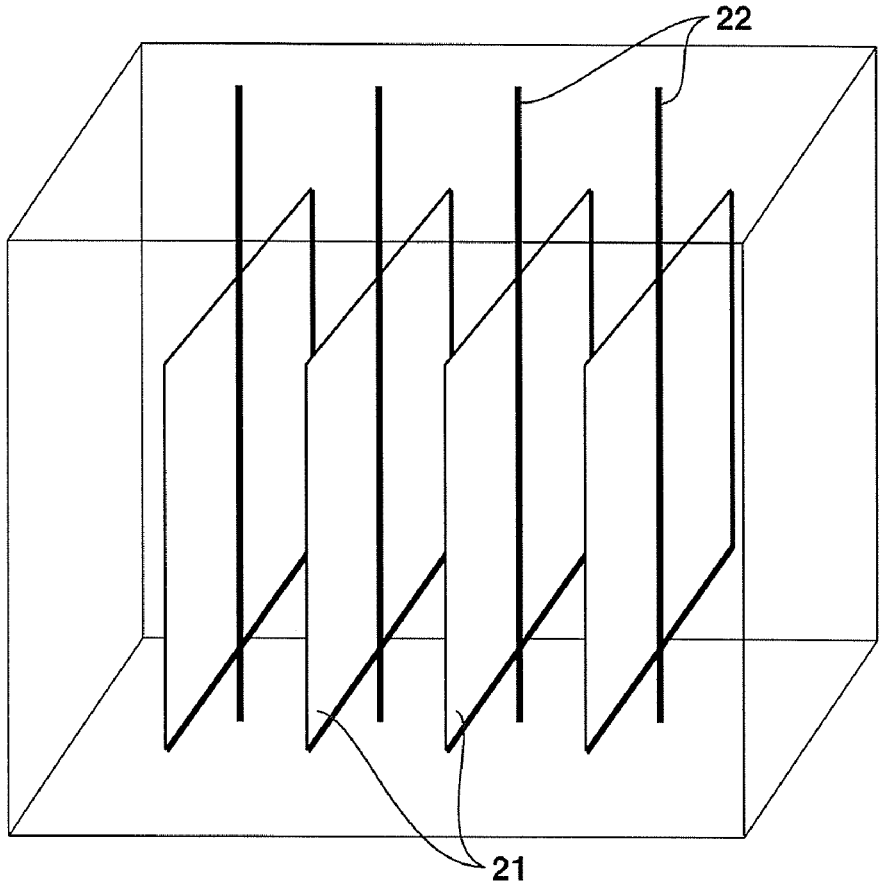
FIG. 2 illustrates vertical fractures created from vertical wells.

The flow chart of FIG. 1 shows the main steps in the present inventive method. In step 1, the deep-lying oil shale (or other hydrocarbon) deposit is fractured and propped. The propped fractures are created from either vertical or horizontal wells (FIG. 2 shows fractures 21 created from vertical wells 22) using known fracture methods such as applying hydraulic pressure (see for example *Hydraulic Fracturing: Reprint Series No.* 28, Society of Petroleum Engineers (1990)). The fractures are preferably parallel and spaced 10-60 m apart and more preferably 15-35 m apart. This will normally require a depth where the vertical stress is greater than the minimum horizontal stress by at least 100 psi so to permit creation of sets of parallel fractures of the indicated spacing without altering the orientation of subsequent fractures. Typically this depth will be greater than 1000 ft. At least two, and preferably at least eight, parallel fractures are used so to minimize the fraction of injected heat ineffectively spent in the end areas below the required maturation temperature. The fractures are propped so to keep the flow path open after heating has begun, which will cause thermal expansion and increase the closure stresses. Propping the fractures is typically done by injecting size-sorted sand or engineered particles into the fracture along with the fracturing fluid. The fractures should have a permeability in the low-flow limit of at least 200 Darcy and preferably at least 500 Darcy. In some embodiments of the invention the fractures are constructed with higher permeability (for example, by varying the proppant used) at the inlet and/or outlet end to aid even distribution of the injected fluids. In some embodiments of the present invention, the wells used to create the fractures are also used for injection of the heating fluid and recovery of the injected fluid and the product.

Figure 3:
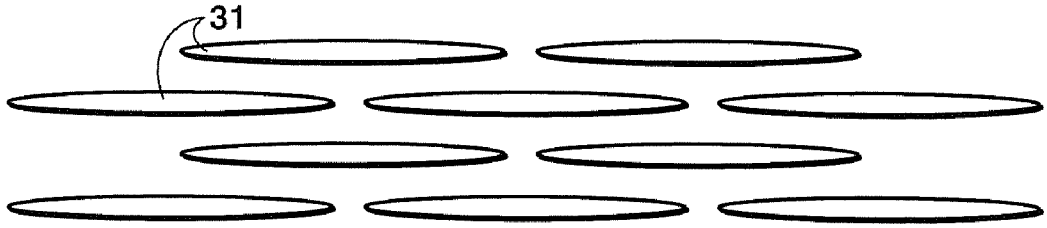
FIG. 3 illustrates a top view of one possible arrangement of vertical fractures associated with vertical wells.

The layout of the fractures associated with vertical wells are interlaced in some embodiments of the invention so to maximize heating efficiency. Moreover, the interlacing reduces induced stresses so to minimize permitted spacing between neighboring fractures while maintaining parallel orientations. FIG. 3 shows a top view of such an arrangement of vertical fractures 31.

In step 2 of FIG. 1, a heated fluid is injected into at least one vertical fracture, and is recovered usually from that same fracture, at a location sufficiently removed from the injection point to allow the desired heat transfer to the formation to occur. The fluid is typically heated by surface furnaces, and/or in a boiler. Injection and recovery occur through wells, which may be horizontal or vertical, and may be the same wells used to create the fractures. Certain wells will have been drilled in connection with step 1 to create the fractures. Depending upon the embodiment, other wells may have to be drilled into the fractures in connection with step 2. The heating fluid, which may be a dense vapor of a substance which is a liquid at ambient surface conditions, preferably has a volumetric thermal density of >30000 kJ/m$^3$, and more preferably >45000 kJ/m$^3$, as calculated by the difference between the mass enthalpy at the fracture inlet temperature and at 270° C. and multiplying by the mass density at the fracture inlet temperature. Pressurized naphtha is an example of such a preferred heating fluid. In some embodiments of the present invention, the heating fluid is a boiling-point cut fraction of the produced shale oil. Whenever a hydrocarbon heating fluid is used, the thermal pyrolysis degradation half-life should be determined at the fracture temperature to preferably be at least 10 days, and more preferably at least 40 days. A degradation or coking inhibitor may be added to the circulating heating fluid; for example, toluene, tetralin, 1,2,3,4-tetrahydroquinoline, or thiophene.

When heating fluids other than steam are used, project economics require recovery of as much as practical for reheating and recycling. In other embodiments, the formation may be heated for a while with one fluid then switched to another. For example, steam may be used during start-up to minimize the need to import naphtha before the formation has produced any hydrocarbons. Alternately, switching fluids may be beneficial for removing scaling or fouling that occurred in the wells or fracture.

A key to effective use of circulated heating fluids is to keep the flow paths relatively short (<~200 m, depending on fluid properties) since otherwise the fluid will cool below a practical pyrolysis temperature before returning. This would result in sections of each fracture being non-productive. Although use of small, short fractures with many connecting wells would be one solution to this problem, economics dictate the desirability of constructing large fractures and minimizing the number of wells. The following embodiments all consider designs which allow for large fractures while maintaining acceptably short flow paths of the heated fluids.

Figure 4:
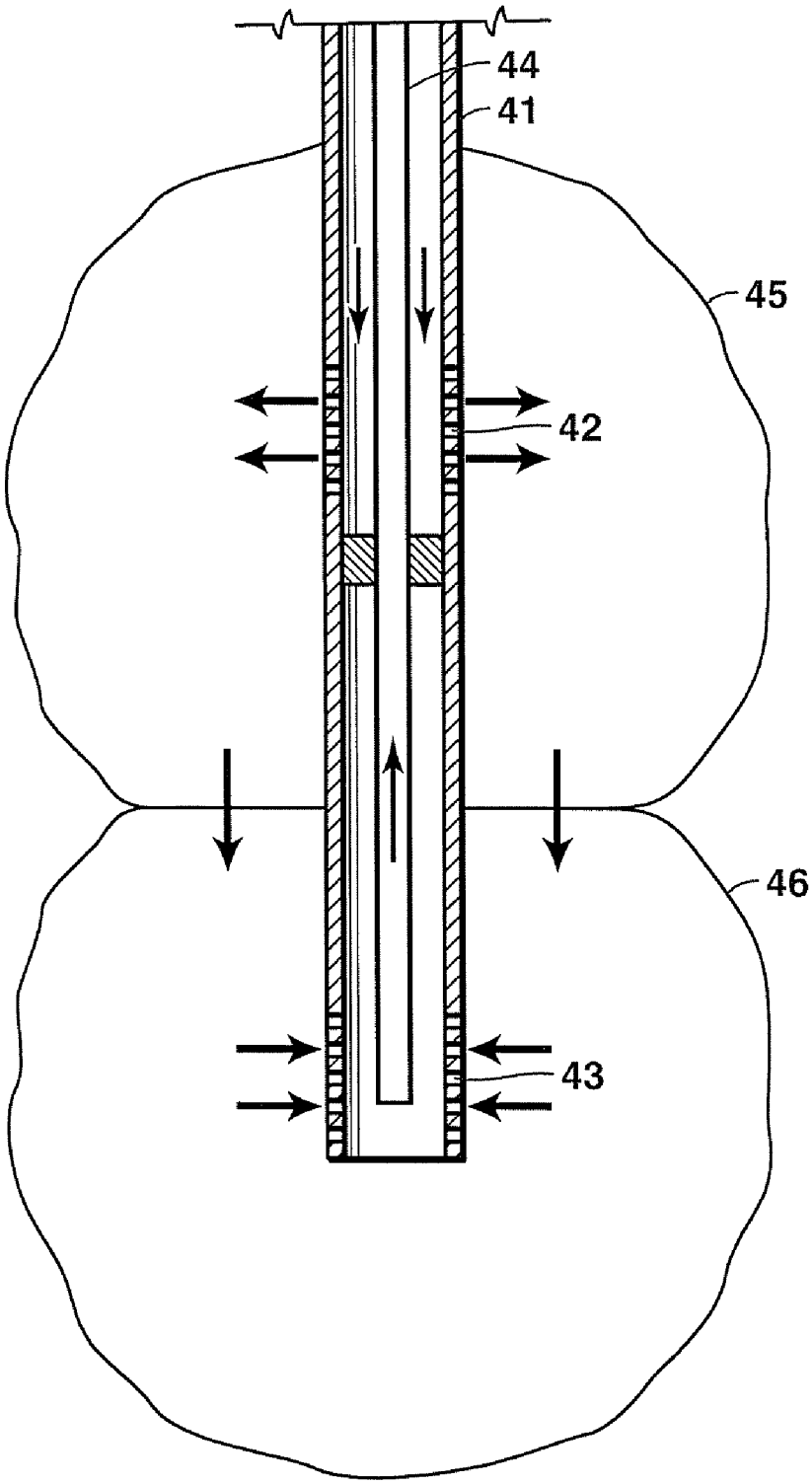
FIG. 4 illustrates dual completion of a vertical well into two intersecting penny fractures.
Figure 5A:
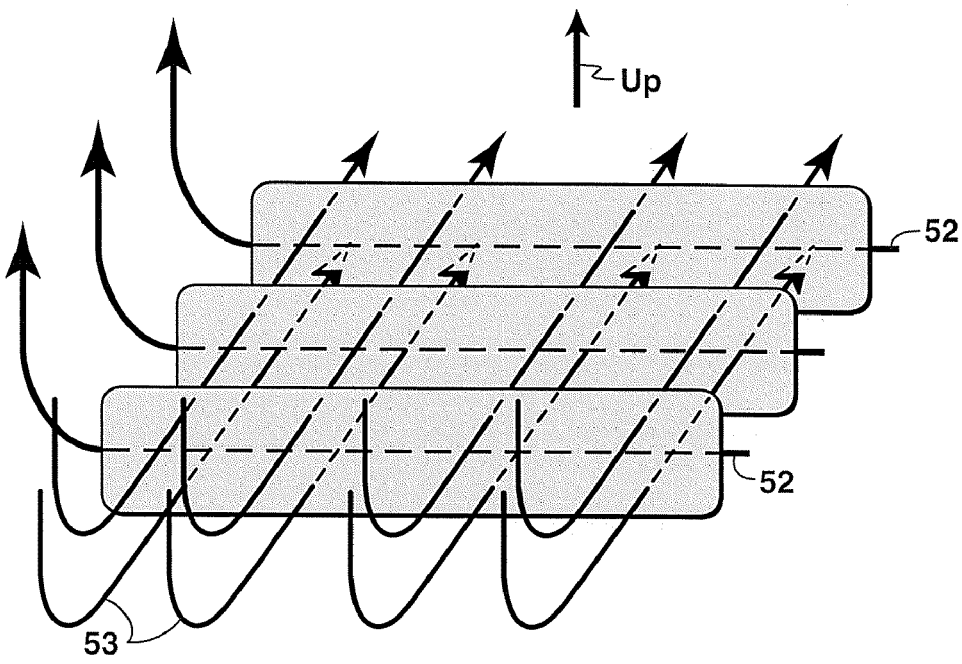
FIG. 5A illustrates a use of horizontal wells in conjunction with vertical fractures.
Figure 5B:
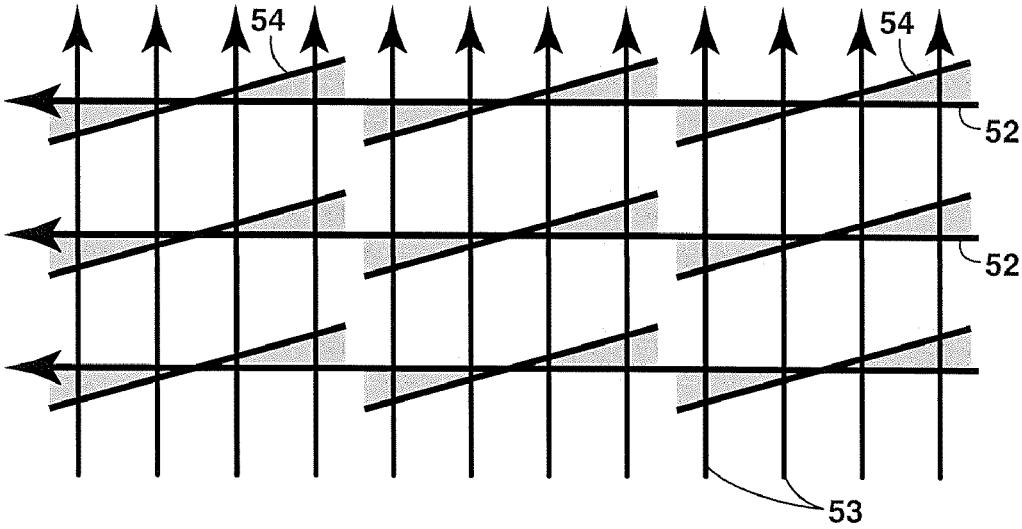
FIG. 5B illustrates a top view of how the configuration of FIG. 5A is robust to en echelon fractures.

In some embodiments of the present invention, as shown in FIG. 4, the vertical fracture flow path is achieved with a dual-completed vertical well 41 having an upper completion 42 where the heating fluid is injected into the formation from the outer annulus of the wellbore through perforations. The cooled fluid is recovered at a lower completion 43 where it is drawn back up to the surface through inner pipe 44. The vertical fracture may be created as the coalescence of two or more "penny" fractures 45 and 46. (The Prats patent describes use of a single fracture.) Such an approach can simplify and speed the well completions by significantly reducing the number of perforations needed for the fracturing process. FIG. 5A illustrates an embodiment in which the fractures 51 are located longitudinally along horizontal wells 52 and are intersected by other horizontal wells 53. Injection occurs through one set of wells and returns through the others. As shown, wells 53 would likely be used to inject the hot fluid into the fractures, and the wells 52 used for returning the cooled fluid to the surface for reheating. The wells 53 are arrayed in vertical pairs, one of each pair above the return well 52, the other below, thus tending to provide more uniform heating of the formation. Vertical well approaches require very tight spacing (<~0.5-1 acre), which may be unacceptable in environmentally sensitive areas or simply for economic reasons. Use of horizontal wells greatly reduces the surface piping and total well footprint area. This advantage over vertical wells can be seen in FIG. 5A where the surface of the substantially square area depicted will have injection wells along one edge and return wells along an adjoining edge, but the interior of the square will be free of wells. Inlet and return heating lines are separated which removes the issue of cross-heat exchange of dual completions. In FIG. 5A, the fractures would probably be generated using wells 52, with the fractures created largely parallel to the generating horizontal well. This approach provides robust flow even with en echelon fractures illustrated in a top view in FIG. 5B (i.e., non-continuous fractures 54 due to the horizontal wells' 52 not being exactly aligned with the fracture direction) which can readily occur due to imperfect knowledge of the subsurface.

Figure 6:
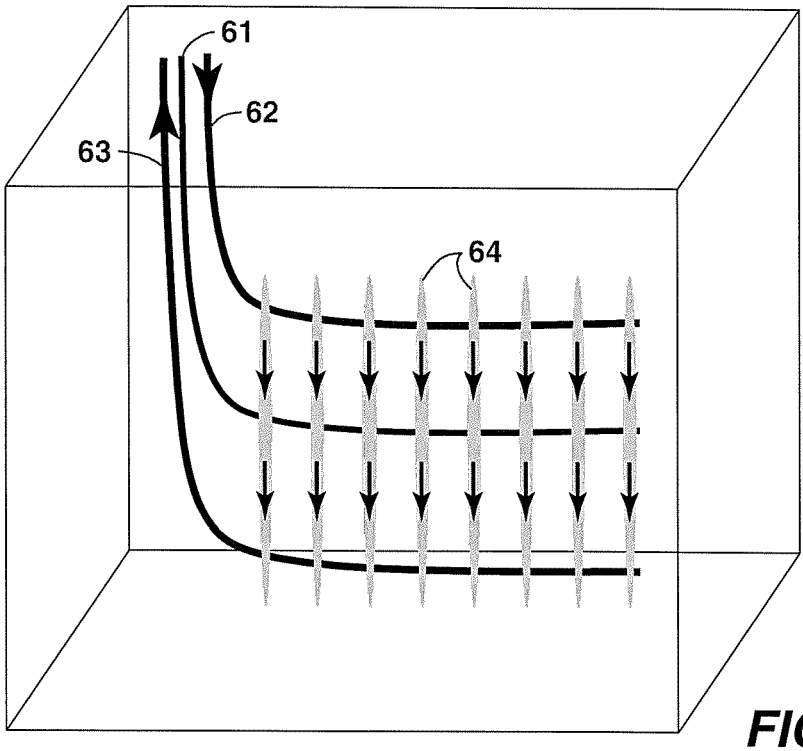
FIG. 6 illustrates horizontal injection, production and fracture wells intersecting parallel vertical fractures perpendicularly.

FIG. 6 shows an embodiment in which vertical fractures 64 are generated substantially perpendicular to a horizontal well 61 used to create the fractures but not for injection or return. Horizontal well 62 is used to inject the heating fluid, which travels down the vertical fractures to be flowed back to the surface through horizontal well 63. The dimensions shown are representative of one embodiment among many. In this embodiment, the fractures might be spaced ~25 m apart (not all fractures shown). In an alternative embodiment (not shown), the wells can be drilled to intersect the fractures at substantially skew angles. (The orientation of the fracture planes is determined by the stresses within the shale.) The advantage of this alternative embodiment is that the intersections of the wells with the fracture planes are highly eccentric ellipses instead of circles, which increase the flow area between the wells and fractures and thus enhance heat circulation.

Figure 7:
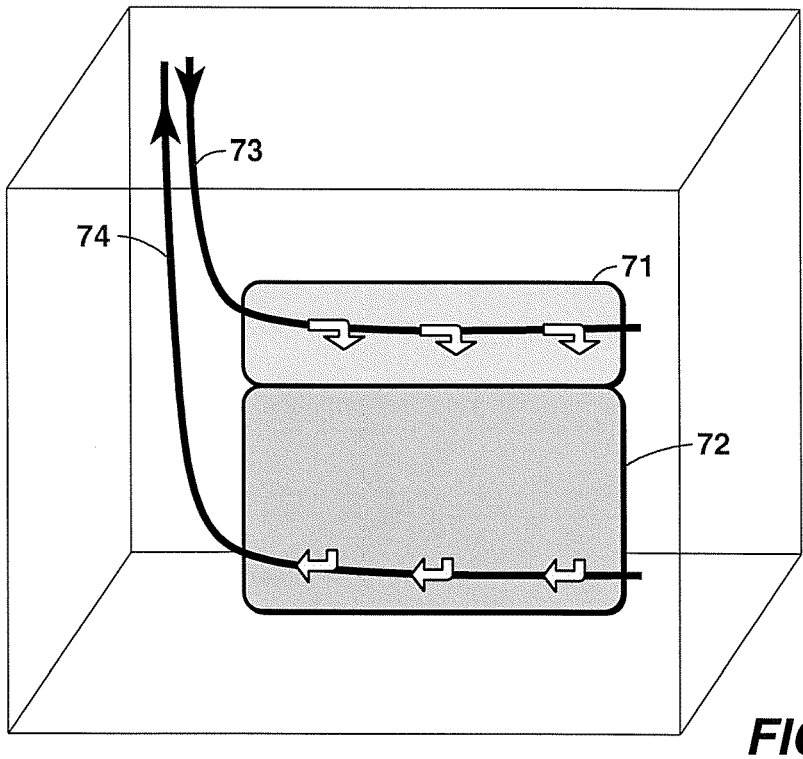
FIG. 7 illustrates coalescence of two smaller vertical fractures to create a flow path between two horizontal wells.

FIG. 7 illustrates an embodiment of the present invention in which two intersecting fractures 71 and 72 are extended and coalesced between two horizontal wells. Injection occurs through one of the wells and return is through the other. The coalescence of two fractures increases the probability that wells 73 and 74 will have the needed communication path, rather than fracturing from only one well and trying to connect or to intersect the fracture with the other well.

Figure 8:
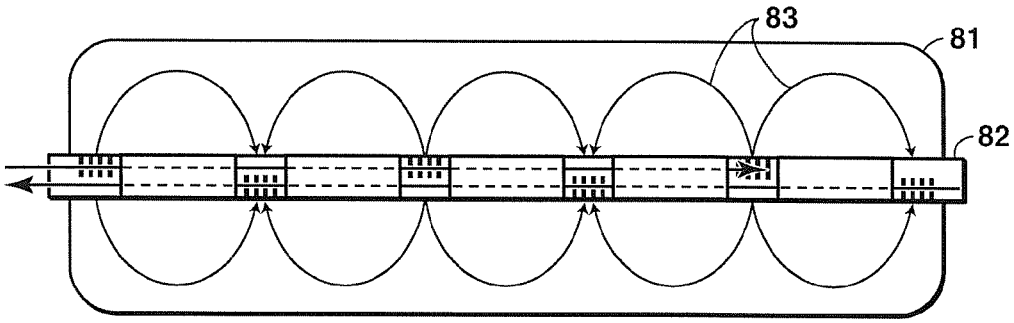
FIG. 8 illustrates the use of multiple completions in a dual pipe horizontal well traversing a long vertical fracture, thereby permitting short flow paths for the heated fluid.

FIG. 8 illustrates an embodiment featuring a relatively long fracture 81 traversed by a single horizontal well 82 with two internal pipes (or an inner pipe and an outer annular region). The well has multiple completions (six shown), with each completion being made to one pipe or the other in an alternating sequence. One of the pipes carries the hot fluid, and the other returns the cooled fluid. Barriers are placed in the well to isolate injection sections of the well from return sections of the well. An advantage to this configuration is that it utilizes a single, and potentially long, horizontal well while keeping the flow paths 83 for the hot fluid relatively short. Moreover, the configuration makes it unlikely that discontinuities in the fracture or locations where the well is in poor communication with the fracture will interrupt all fluid circulation.

For the construction of wells intersecting fractures, the fractures are pressurized above the drilling mud pressure so to prevent mud from infiltrating into the fracture and harming its permeability. Pressurization of the fracture is possible since the target formation is essentially impermeable to flow, unlike the conventional hydrocarbon reservoirs or naturally permeable oil shales.

The fluid entering the fracture is preferably between 260-370° C. where the upper temperature is to limit the tendency of the formation to plastically deform at high temperatures and to control pyrolysis degradation of the heating fluid. The lower limit is so the maturation occurs in a reasonable time. The wells may require insulation to allow the fluid to reach the fracture without excessive loss of heat.

In preferred embodiments of the invention, the flow is strongly non-Darcy throughout most of the fracture area (i.e. the $v^2$-term of the Ergun equation contributes >25% of the pressure drop) which promotes more even distribution of flow in the fracture and suppresses channeling. This criterion implies choosing the circulating fluid composition and conditions to give high density and low viscosity and for the proppant particle size to be large. The Ergun equation is a well-known correlation for calculating pressure drop through a packed bed of particles:

$$dP/dL=[1.75(1-\in)\rho v^2/(\in^3 d)]+[150(1-\in)^2\mu v/(\in^3 d^2)]$$

where P is pressure, L is length, □ is porosity, □ is fluid density, v is superficial flow velocity, □ is fluid viscosity, and d is particle diameter.

In preferred embodiments, the fluid pressure in the fracture is maintained for the majority of time at >50% of fracture opening pressure and more preferably >80% of fracture opening pressure in order to maximize fluid density and minimize the tendency of the formation to creep and reduce fracture flow capacity. This pressure maintenance may be done by setting the injection pressure.

In step 3 of FIG. 1, the produced oil and gas is recovered commingled with the heating fluid. Although the shale is initially essentially impermeable, this will change and the permeability will increase as the formation temperature rises due to the heat transferred from the injected fluid. The permeability increase is caused by expansion of kerogen as it matures into oil and gas, eventually causing small fractures in the shale that allows the oil and gas to migrate under the applied pressure differential to the fluid return pipes. In step 4, the oil and gas is separated from the injection fluid, which is most conveniently done at the surface. In some embodiments of the present invention, after sufficient production is reached, a separator or distillate fraction from the produced fluids may be used as makeup injection fluid. At a later time in what may be expected to be a ~15 year life, heat addition may be stopped which will allow thermal equilibrium to even out the temperature profile, although the oil shale may continue to mature and produce oil and gas.

For environmental reasons, a patchwork of reservoir sections may be left unmatured to serve as pillars to mitigate subsidence due to production.

Figure 9:
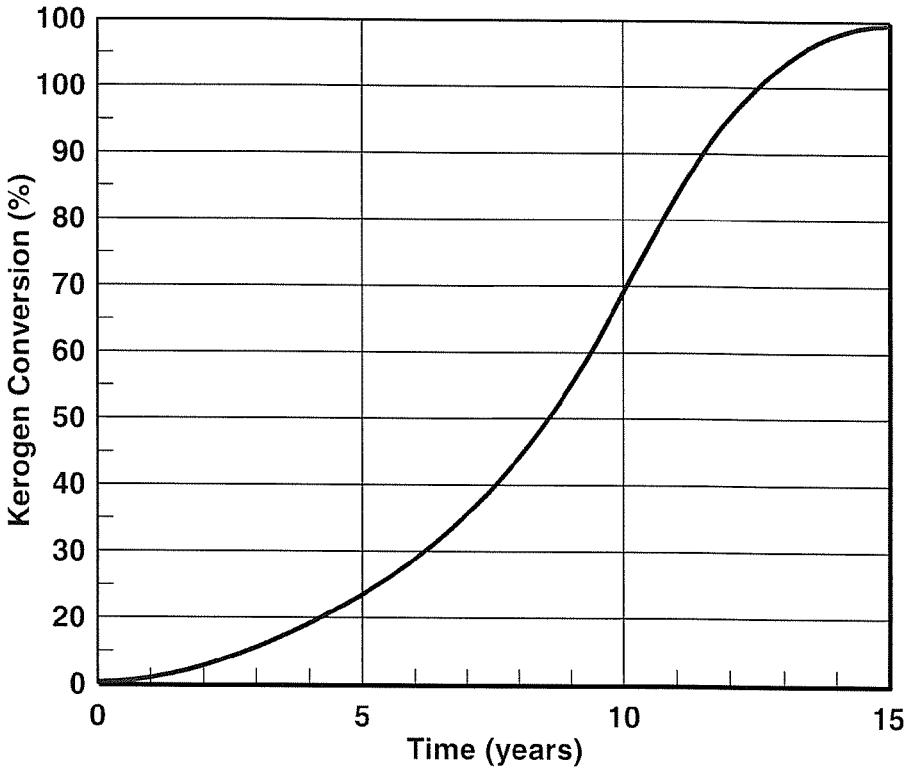
FIG. 9 shows a modeled conversion as a function of time for a typical oil shale zone between two fractures 25 m apart held at 315° C.

The expectation that the above-described method will convert all kerogen in ~15 years is based on model calculations. FIG. 9 shows the modeled kerogen conversion (to oil, gas, and coke) as a function of time for a typical oil shale zone between two fractures 25 m apart held at 315° C. Assuming 30 gal/ton, the average production rate is ~56 BPD (barrels per day) for a 100 m×100 m heated zone assuming 70% recovery. The estimated amount of circulated naphtha required for the heating is 2000 kg/$m_{width}$/day, which is 1470 BPD for a 100 m wide fracture.

Figure 10:
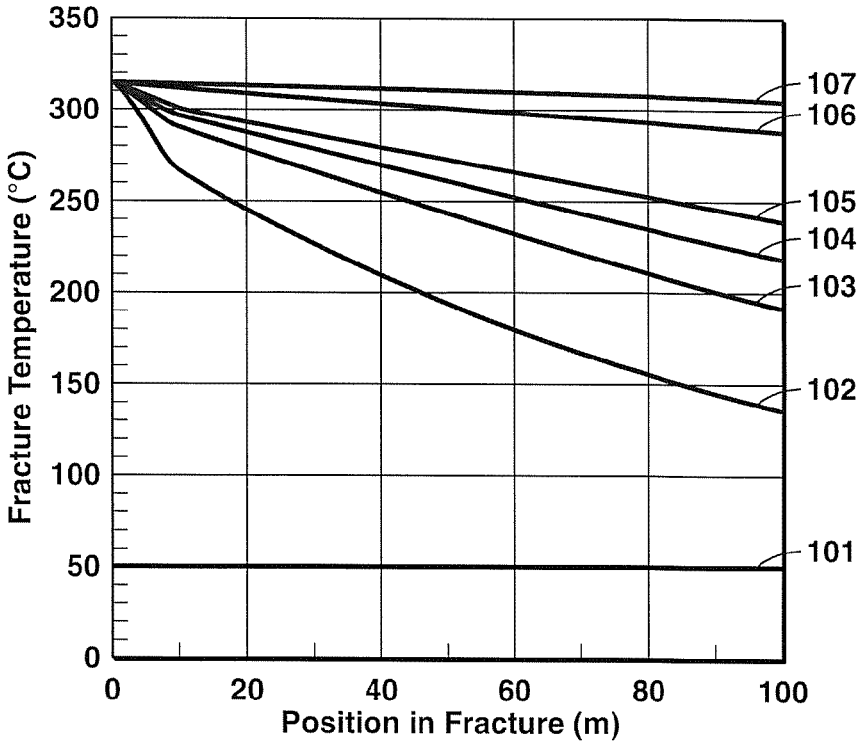
FIG. 10 shows the estimated warmup along the length of the fracture for different heating times.

FIG. 10 shows the estimated warm-up of the fracture for the same system. The inlet of the fracture heats up quickly but it takes several years for the far end to heat to above 250° C. This behavior is due to the circulating fluid losing heat as it flows through the fracture. Flat curve 101 shows the temperature along the fracture before the heated fluid is introduced. Curve 102 shows the temperature distribution after 0.3 yr. of heating; curve 103 after 0.9 yr.; curve 104 after 1.5 yr.; curve 105 after 3 yr.; curve 106 after 9 yr.; and curve 107 after 15 yr.

The heating behaviors shown in FIGS. 9 and 10 were calculated via numerical simulation. In particular, thermal flow in the fracture is calculated and tracked, thus leading to a spatially non-uniform temperature of the fractures since the injected hot fluid cools as it loses heat to the formation. The maturation rate of the kerogen is modeled as a first-order reaction with a rate constant of $7.34\times10^9\ s^{-1}$ and an activation energy of 180 kJ/mole. For the case shown, the heating fluid is assumed to have a constant heat capacity of 3250 J/kg·° C. and the formation has a thermal diffusivity of 0.035 $m^2$/day.

The foregoing description is directed to particular embodiments of the present invention for the purpose of illustrating it. It will be apparent, however, to one skilled in the art, that many modifications and variations to the embodiments described herein are possible. For example, some of the drawings show a single fracture. This is done for simplicity of illustration. In preferred embodiments of the invention, at least eight parallel fractures are used for efficiency reasons. Similarly, some of the drawings show heated fluid injected at a higher point in the fracture and collected at a lower point, which is not a limitation of the present invention. Moreover, the flow may be periodically reversed to heat the formation more uniformly. All such modifications and variations are intended to be within the scope of the present invention, as defined in the appended claims.

We claim:

1. An in situ method for maturing and producing oil and gas from a deep-lying, impermeable formation containing immobile hydrocarbons, comprising the steps of:

(a) pressure fracturing a region of the hydrocarbon formation, creating a plurality of substantially vertical, propped fractures;

(b) injecting under pressure a heated fluid into a first part of each vertical fracture, and recovering the injected fluid from a second part of each fracture for reheating and recirculation, said pressure being less than the fracture opening pressure, said injected fluid being heated sufficiently that the fluid temperature upon entering each fracture is at least 260° C. but not more than 370° C., and the separation between said first and second parts of each fracture being less than or approximately equal to 200 meters;

(c) recovering, commingled with the injected fluid, oil and gas matured in the region of the hydrocarbon formation due to heating of the region by the injected fluid, the permeability of the formation being increased by such heating thereby allowing flow of the oil and gas into the fractures; and (d) separating the produced oil and gas from the recovered injection fluid.

2. The method of claim 1, wherein the hydrocarbon formation is oil shale.

3. The method of claim 2, wherein the oil shale region to be fractured lies about 1,000 feet or more below the earth's surface.

4. The method of claim 1, wherein the fractures are substantially parallel.

5. The method of claim 4, wherein at least eight fractures are created, spaced substantially uniformly at a spacing in the range 10-60 m, said fractures being propped to have permeability of at least 200 Darcy.

6. The method of claim 1, wherein at least one well is used to create the fractures and to inject and recover the heated fluid from the fractures.

7. The method of claim 6, wherein all wells are vertical wells.

8. The method of claim 6, wherein all wells are horizontal wells.

9. The method of claim 6, wherein wells used to create fractures are also used for injection and recovery.

10. The method of claim 6, wherein the injection and recovery wells have a plurality of completions in each fracture, at least one completion being used for injection of the heated fluid and at least one completion being used for recovery of the injected fluid.

11. The method of claim 10, wherein the injection and return completions are periodically reversed to cause a more even temperature profile across the fracture.

12. The method of claim 10, wherein the injection well and the recovery well have three or more completions in each fracture, and at least one completion of the three or more completions is used for injection of the heated fluid and at least one completion of the three or more completions is used for recovery of the injected fluid.

13. The method of claim 6, wherein the wells lie substantially within the plane of their associated fractures.

14. The method of claim 6, wherein the planes of the fractures are substantially parallel and the wells are horizontal and substantially perpendicular to the planes of the fractures.

15. The method of claim 6, wherein wells that intersect fractures are drilled while the fractures are pressurized above the drilling mud pressure.

16. The method of claim 6, wherein the fracture comprises two or more smaller fractures.

17. The method of claim 6, wherein a flow path is created for the injected and recovered fluids by intersecting the fracture with one or more wells substantially perpendicular to the plane of the fractures.

18. The method of claim 17, wherein the fractures are substantially perpendicular to the direction of the wells from which they are formed.

19. The method of claim 1, wherein the injected fluid is saturated steam and the injection pressure is in the range 1,200-3,000 psia, but not more than the fracture opening pressure.

20. The method of claim 1, wherein the depth of the heated region of the formation is at least 1,000 ft.

21. The method of claim 1, wherein the heating of the hydrocarbon formation is continued at least until the temperature distribution across each fracture is substantially constant.

22. The method of claim 1, wherein the depth of the heated region of the hydrocarbon formation is below the lowest-lying aquifer and a patchwork of sections of the hydrocarbon formation are left unheated to serve as pillars to prevent subsidence.

23. The method of claim 1, wherein the fluid pressure maintained in each fracture is at least 50% of the fracture opening pressure.

24. The method of claim 1, wherein the fluid pressure maintained in each fracture is at least 80% of the fracture opening pressure.

25. The method of claim 1, wherein non-Darcy flow of the injected fluid is substantially maintained throughout each fracture to the degree that the velocity squared term in the Ergun equation contributes at least 25% of the pressure drop calculated by such equation.

26. The method of claim 1, wherein a degradation or coking inhibitor is added to the injected fluid.

27. The method of claim 1, wherein the hydrocarbon region to be fractured lies about 1,000 feet or more below the earth's surface.

* * * * *